US006819290B2

(12) United States Patent
Hani et al.

(10) Patent No.: US 6,819,290 B2
(45) Date of Patent: Nov. 16, 2004

(54) VARIABLE MULTI-BAND PLANAR ANTENNA ASSEMBLY

(75) Inventors: Mohammad Bani Hani, Lindenhurst, IL (US); Aamir A. Abbasi, Mundelein, IL (US)

(73) Assignee: Motorola Inc., Schaumburg, IL (US)

( * ) Notice: Subject to any disclaimer, the term of this patent is extended or adjusted under 35 U.S.C. 154(b) by 0 days.

(21) Appl. No.: 10/409,304

(22) Filed: Apr. 8, 2003

(65) Prior Publication Data

US 2004/0201527 A1 Oct. 14, 2004

(51) Int. Cl.[7] ..... H01Q 1/38
(52) U.S. Cl. ..... 343/700 MS; 343/702
(58) Field of Search ..... 343/700 MS, 846, 343/848, 702, 745, 749, 815, 833, 834

(56) References Cited

U.S. PATENT DOCUMENTS

| | | | | | |
|---|---|---|---|---|---|
| 5,382,959 | A | * | 1/1995 | Pett et al. | 343/700 MS |
| 5,661,494 | A | * | 8/1997 | Bondyopadhyay | 343/700 MS |
| 6,069,587 | A | | 5/2000 | Lynch et al. | |
| 6,191,740 | B1 | | 2/2001 | Kates et al. | |
| 6,297,776 | B1 | * | 10/2001 | Pankinaho | 343/700 MS |
| 6,362,789 | B1 | | 3/2002 | Trumbull et al. | |
| 6,466,170 | B2 | | 10/2002 | Zhou | |
| 6,473,042 | B1 | * | 10/2002 | Fang et al. | 343/700 MS |
| 6,476,769 | B1 | | 11/2002 | Lehtola | |
| 6,498,586 | B2 | | 12/2002 | Pankinaho | |
| 6,501,427 | B1 | | 12/2002 | Lilly et al. | |
| 2001/0007445 | A1 | | 7/2001 | Pankinaho | |
| 2002/0135521 | A1 | | 9/2002 | Moore | |
| 2002/0140607 | A1 | | 10/2002 | Zhou | |
| 2002/0180650 | A1 | | 12/2002 | Pankinaho et al. | |
| 2002/0183013 | A1 | | 12/2002 | Auckland et al. | |
| 2004/0090370 | A1 | * | 5/2004 | McCarrick | 343/700 MS |

* cited by examiner

*Primary Examiner*—Tan Ho
(74) *Attorney, Agent, or Firm*—Sylvia Chen

(57) ABSTRACT

A variable multi-band planar reference antenna assembly (200) has a ground plane element, a dual-bandplanar reference antenna structure element (230), and an electrically-coupled variable secondary radiator element (250) which allows tuning from one set of frequency bands to another set of frequency bands by changing the field fringing capacitances and inductances formed between the dual-band planar reference antenna element (230) and the variable secondary radiator element (250). Tuning can be performed using a variety of techniques, including changing the relative position of the dual-band planar reference antenna structure element with respect to the secondary radiator, changing the geometry of the secondary radiator, and/or coupling passive or active capacitive and inductive elements to the dual-band planar reference antenna structure element (230) and/or the secondary radiator (250). This variable multi-band planar antenna assembly is particularly useful in mobile telephone applications, or other wireless communication device applications.

20 Claims, 11 Drawing Sheets

VARIABLE MULTI-BAND PLANAR ANTENNA ASSEMBLY

FIELD OF THE DISCLOSURE

This disclosure relates generally to multi-band antenna assemblies, and more particularly to extending a single dual-band planar antenna structure to cover additional bands.

BACKGROUND OF THE DISCLOSURE

In order to create an antenna that operates in multiple frequency bands, manufacturers often had to switch between two or more separate antenna structures. For example, in the mobile telephone field, a first dual band antenna is used for U.S. bands GSM 850 (824–894 MHz) and PCS 1900 (1850–1990 MHz) while a second dual band antenna is used for European bands E-GSM 900 (880–960 MHz) and DCS 1800 (1710–1880 MHz). By switching between two dual-band antenna structures in a mobile telephone, a user could communicate on all four bands (GSM 850, E-GSM 900, DCS 1800, and PCS 1900). Alternately, a mobile telephone could have one dual-band antenna structure and a single band antenna structure where the interaction of one or more of the antenna structures produces operation in up to four bands. Including two antenna structures in a mobile telephone, however, creates a larger antenna assembly, which can be undesirable from a user's standpoint.

Additionally, the option of two dual-band antenna structures complicates manufacturing and inventory processes even when manufacturing only for two bands, because the manufacturer needs to select one dual-band antenna for a mobile telephone that will operate only in the U.S. GSM bands and another dual-band antenna for a mobile telephone that will operate only in the European GSM bands.

Thus, there is a need for a multi-band antenna assembly that does not involve two or more separate antenna structures. There is also a need for a multi-band antenna assembly that allows variations in the bands to improve tuning and coverage.

The various aspects, features and advantages of the disclosure will become more fully apparent to those having ordinary skill in the art upon careful consideration of the following Drawings and accompanying Detailed Description.

DETAILED DESCRIPTION OF THE PREFERRED EMBODIMENTS

A variable multi-band planar antenna assembly has a ground plane element, a planar reference antenna element, and an electrically-coupled variable secondary radiator element which allows tuning from one set of frequency bands to another set of frequency bands by changing the field fringing capacitances and inductances formed between the dual-band planar reference antenna element and the variable secondary radiator element. Tuning can be performed using a variety of techniques, including changing the relative position of the dual-band planar reference antenna element with respect to the secondary radiator, changing the geometry of the secondary radiator, and/or coupling passive or active capacitive and inductive elements to the dual-band planar reference antenna element and/or the secondary radiator. By using these tuning methods instead of using pin diode electrical switches for tuning, current drain is reduced. This is helpful for a mobile telephone application, or other wireless communication device application, of the variable multi-band planar antenna assembly, especially when the mobile telephone is in standby mode.

In a preferred embodiment, a variable multi-band planar antenna assembly creates a quad-band antenna assembly by using a variable secondary resonator with a dual-band antenna element. The secondary resonator can be varied in dimension, location, and/or capacitive-inductive values to create frequency bands in addition to that of the basic dual-band antenna element. In a preferred embodiment, the variable multi-band planar antenna assembly allows the tuning of a single dual band antenna element to two separate pairs of frequency bands and eliminates the need for two or more separate antenna structures.

Figure 1:
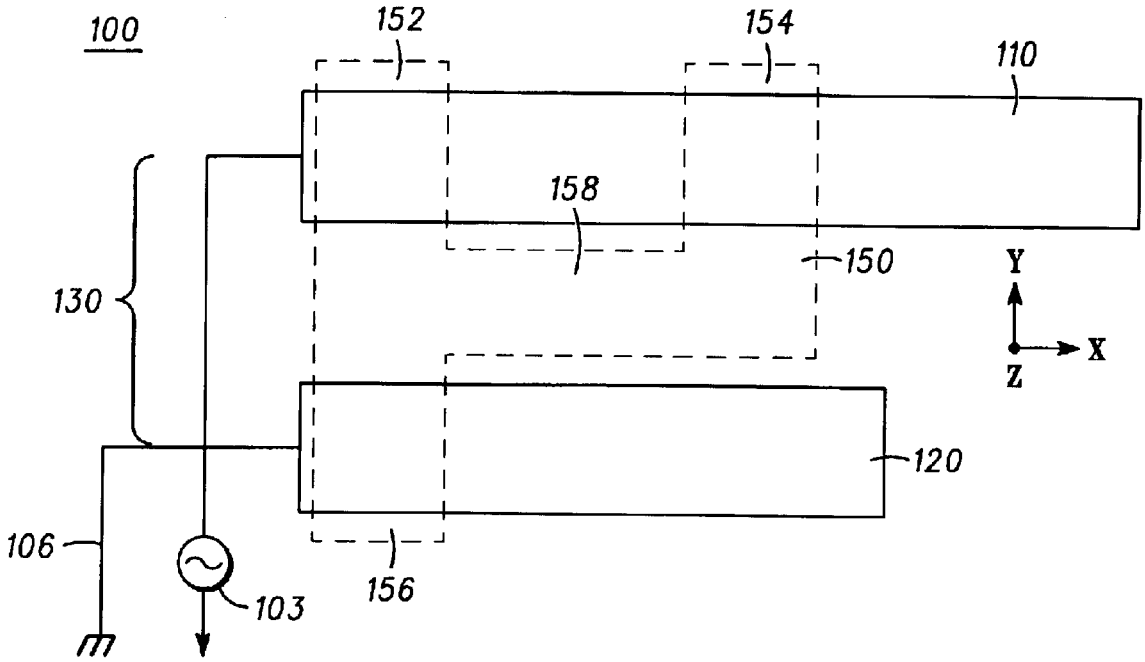
FIG. 1 shows a distributed equivalent circuit model for a variable multi-band planar antenna assembly.

FIG. 1 shows a distributed equivalent circuit model 100 for a variable multi-band planar antenna assembly. An equivalent circuit model 100 uses a dual-band planar reference antenna element 130 with a low-band reference element 110 and a high-band reference element 120. According to a preferred embodiment, the dual-band antenna element 130 is a planar inverted-F antenna (PIFA) with the attendant feed structure 103 and fixed gamma match ground structure 106.

A variable secondary radiator 150 is added to the dual-band planar reference antenna 130 with a variable first low-band capacitance structure 152, a variable second low-band capacitance structure 154, a variable high-band capacitance structure 156, and a variable inductance structure 158.

The geometries (including shapes and surface areas) and positions of the variable secondary radiator 150 are partially dependent upon the geometries of the dual-band planar reference antenna 130 and the desired resonant frequency bands and bandwidths. Aside from this dependency, however, there are many options for the geometries and positions of the variable secondary radiator 150 and, potentially, a large number of variable secondary radiator 150 implementations can be used to achieve a specific multi-band result.

Figure 2:
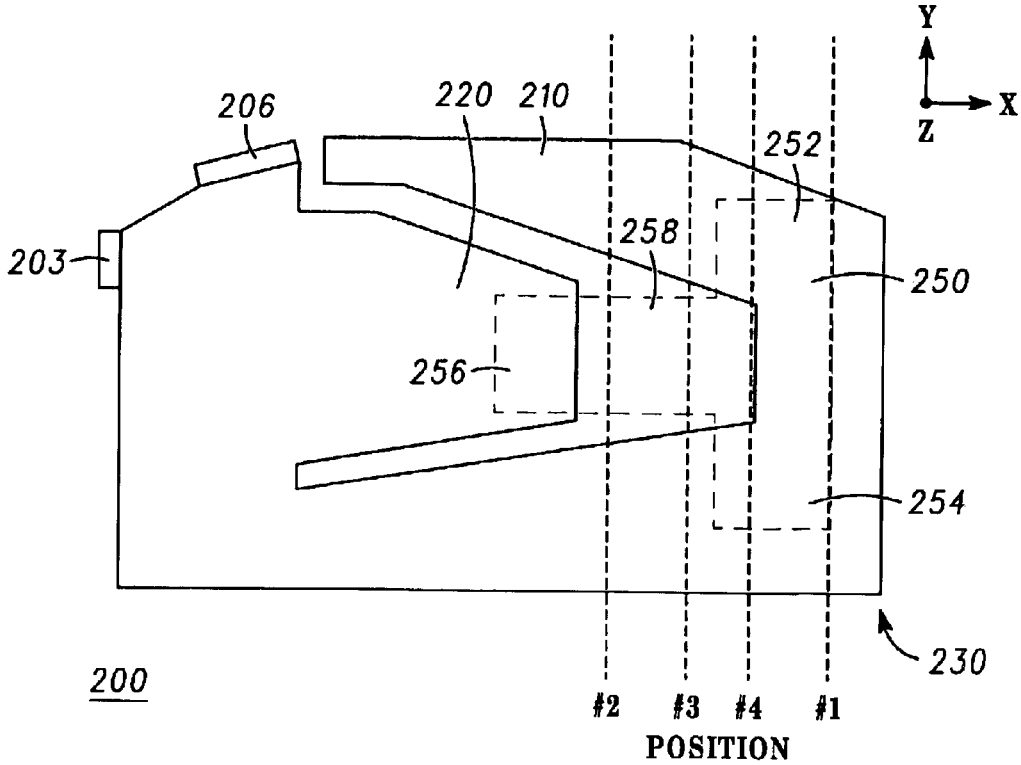
FIG. 2 shows a top view of a variable multi-band planar antenna assembly according to a first preferred embodiment.

FIG. 2 shows a top view of a variable multi-band planar antenna assembly 200 according to a first preferred embodiment. In this first preferred embodiment, a dual-band planar reference antenna 230 is in the form of a C-shaped PIFA with a low-band reference element 210 and a high-band reference element 220. Dual-band planar reference antenna 230 includes a feed post 203 and a ground post 206. Alternate dual-band planar reference antenna geometries are possible, including L, N, M, W, and meandering PIFAs. Additionally, PILAs (planar inverted-L antennas) and other planar antennas can be used as dual-band planar reference antennas. This first preferred embodiment uses a C-shaped PIFA antenna due to its small size and compact shape.

A variable secondary radiator 250, formed in the shape of a T, has a first low-band capacitance structure 252, a second low-band capacitance structure 254, a high-band capacitance structure 256, and an inductance structure 258. The geometry of this variable secondary radiator 250 is due in part to the geometry of the C-shaped PIFA dual-band planar reference antenna 230. Alternate secondary radiator geometries are available for a C-shaped PIFA dual-band planar reference antenna as described later in connection with FIG. 9. If a dual-band planar reference antenna has a different geometry, a differently-shaped variable secondary radiator may be more appropriate. The variable secondary radiator 250 is moveable in the X, Y, and Z directions. In the first preferred embodiment, the desired results for a quad-band GSM mobile telephone can be achieved with movement simply in the X direction. Sample locations are shown as positions 1, 2, 3, and 4, and FIG. 2 shows the variable secondary radiator 250 at position 1.

Instead of moving the secondary resonator 250 to vary the capacitances and inductances of the variable multi-band planar antenna assembly 200, the secondary resonator 250 can be stationary and the dual-band planar reference antenna 230 can be moved instead. Additionally, both the secondary resonator 250 and the dual-band planar reference antenna 230 could be moveable. Because the relative positions of the secondary resonator 250 and the dual-band planar reference antenna 230 affect the capacitances and inductances of the variable multi-band planar antenna assembly 200, a variety of physical options can be used to achieve the desired results.

Figure 3:
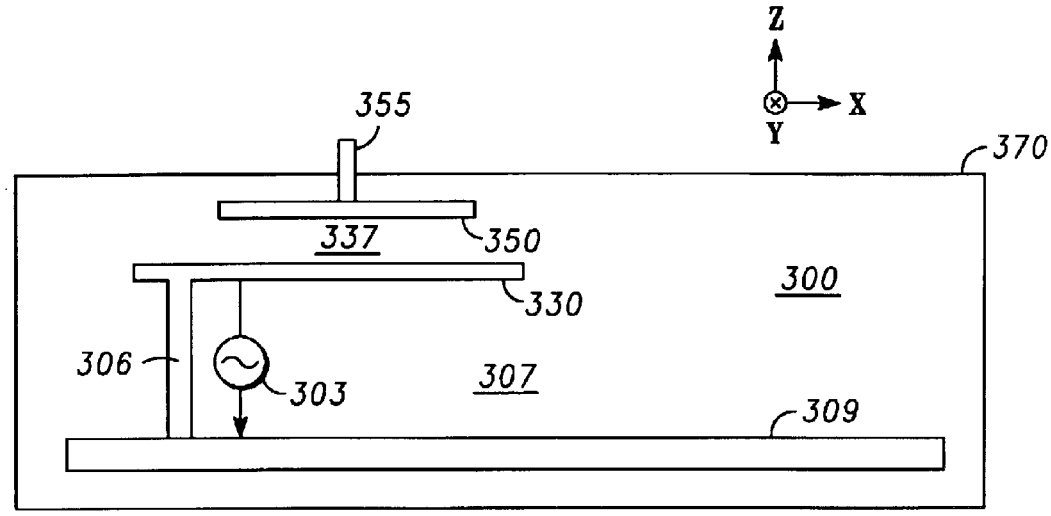
FIG. 3 shows a side view of a variable multi-band planar antenna assembly according to the first preferred embodiment.

FIG. 3 shows a side view of a variable multi-band planar antenna assembly 300 according to the first preferred embodiment. A dielectric layer 307 separates a dual-band planar reference antenna 330 from a ground plane 309. The dielectric layer 307 can be an air gap, plastic, printed circuit board (FR4), Mylar™ polyester film, ceramic, or other material. Because the dual-band planar reference antenna 330 is a PIFA in this first preferred embodiment, the dual-band planar reference antenna 330 also includes a feed structure 303 and a fixed gamma match ground structure 306.

Another dielectric layer 337, which can be an air gap, plastic, printed circuit board (FR4), Mylar™ polyester film, ceramic, or other material, separates a variable secondary radiator 350 from the dual-band planar reference antenna 330. In this first preferred embodiment, the variable secondary radiator 350 mounts to a housing 370 of the variable multi-band planar antenna assembly 300 to allow a latch 355 attached to the variable secondary radiator 350 to extend through the housing 370. The variable secondary radiator 350, however, can be mounted to the variable multi-band planar antenna assembly 300. Additionally, the variable secondary radiator 350 could be mounted below the dual-band planar reference antenna 330 if a latch 355 is undesirable. Preferably, the housing 370 is constructed of plastic and has only minor effects on the performance of the variable multi-band planar antenna assembly 300. Additionally, the variable secondary radiator 350 is moveable in the X, Y, and/or Z directions. In the first preferred embodiment, the desired results for a quad-band GSM mobile telephone can be achieved with movement simply in the X direction.

Instead of moving the secondary resonator 350 to vary the capacitances and inductances of the variable multi-band planar antenna assembly 300, the secondary resonator 350 can be kept stationary and the dual-band planar reference antenna 330 can be moved instead. Additionally, both the secondary resonator 350 and the dual-band planar reference antenna 330 could be moveable. Because the relative positions of the secondary resonator 350 and the dual-band planar reference antenna 330 affect the capacitances and inductances of the variable multi-band planar antenna assembly 300, a variety of physical options can be used to achieve the desired results.

Figure 4:
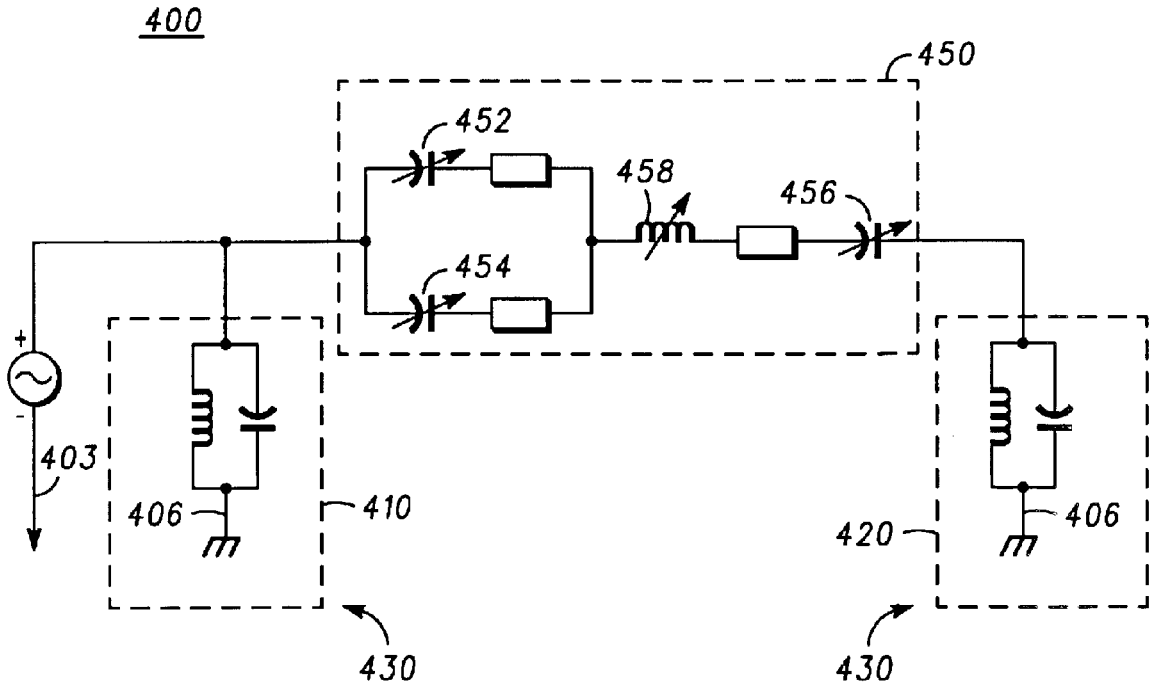
FIG. 4 shows a lumped electrical equivalent element model for a variable multi-band planar antenna assembly.

FIG. 4 shows a lumped electrical equivalent element model 400 for a variable multi-band planar antenna assembly. The lumped electrical equivalent element model 400 uses a dual-band planar reference antenna element 430 with a low-band reference element 410 and a high-band reference element 420. According to a preferred embodiment, the dual-band antenna element 430 is a planar inverted F antenna (PIFA) with an attendant feed structure 403 and a fixed gamma match ground structure 406.

A variable secondary radiator 450 is added to the dual-band planar reference antenna 430 with a variable first low-band capacitance structure 452, a variable second low-band capacitance structure 454, a variable high-band capacitance structure 456, and a variable inductance structure 458. The variable secondary radiator 450 can be implemented in a variety of ways, as demonstrated in the Detailed Description.

Figure 5:
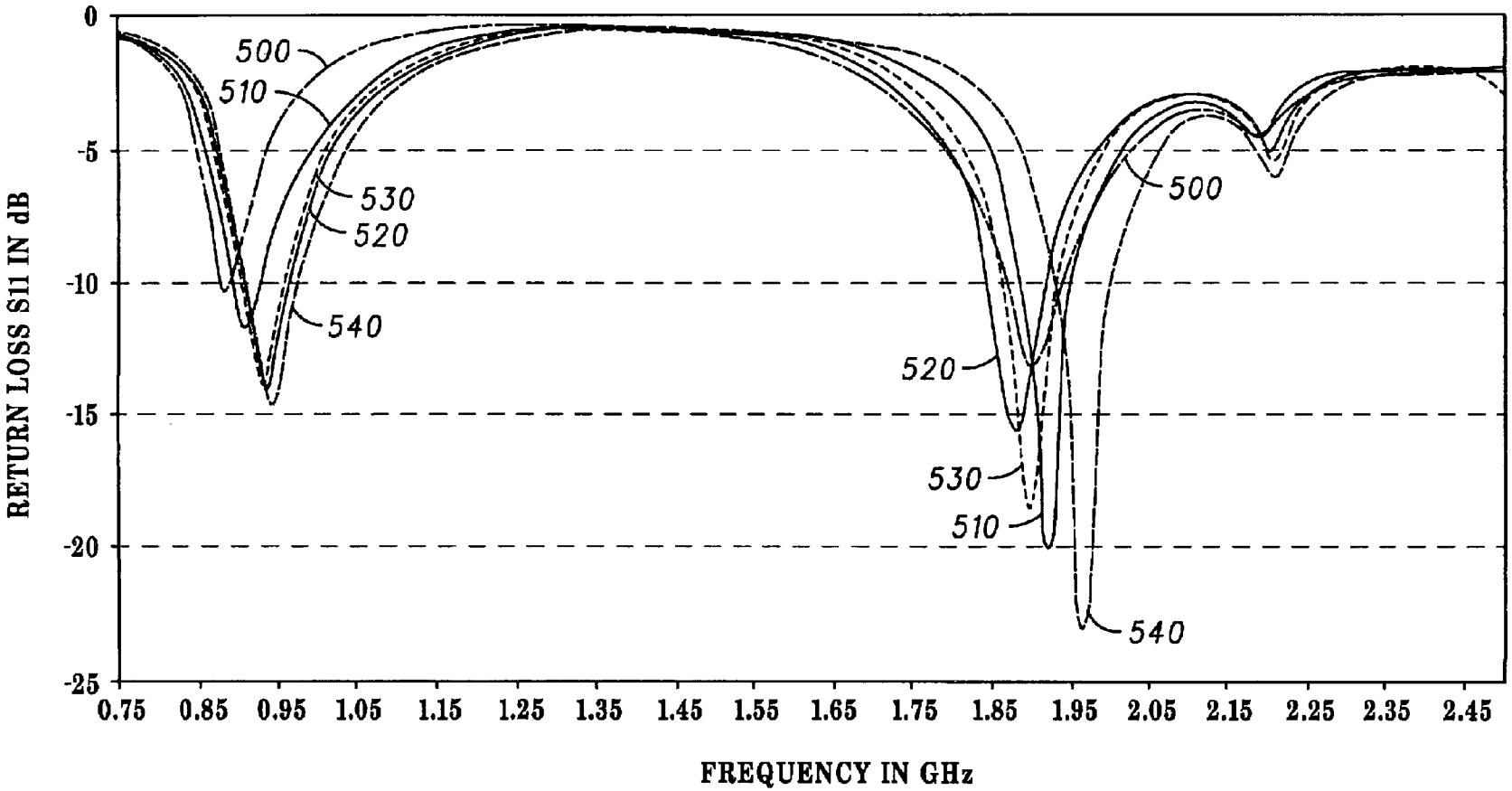
FIG. 5 shows return losses for the first preferred embodiment shown in FIGS. 2 and 3.

FIG. 5 shows return losses for the first preferred embodiment shown in FIGS. 2 and 3, which demonstrates the resonance movements of the first preferred embodiment. The dual-band planar reference antenna 230 shown in FIG. 2 has a return loss curve 500 with poles at approximately 0.87 GHz and 1.86 GHz. Adding the variable secondary radiator 250 shown in FIG. 2 at position 1 in FIG. 2 creates a curve 510 with poles at approximately 0.92 GHz and 1.93 GHz. Moving the variable secondary radiator 250 shown in FIG. 2 to position 2 in FIG. 2 creates a curve 520 with poles at approximately 0.94 GHz and 1.89 GHz. Movement of the variable secondary radiator 250 shown in FIG. 2 to additional positions 3 and 4 in the X direction results in further changes to the pole locations as shown by curves 530 and 540 respectively. FIG. 5 demonstrates how the variable multi-band planar antenna assembly can be used to modify a dual-band planar reference antenna 230 to cover at least four frequency bands simply by moving the variable secondary radiator 250 shown in FIG. 2 in the X direction.

Notice how the pole for the GSM 850 band at position 1 shifts up to E-GSM 900 at position 2 while the pole for the PCS 1900 band at position 1 shifts down to DCS 1800 at position 2. At position 1, the variable multi-band planar antenna assembly operates on both U.S. GSM bands; at position 2, the variable multi-band planar antenna assembly operates on both European GSM bands. Thus, quad-band GSM tuning is achieved when the variable secondary resonator 250 is at appropriate positions between the high impedance point and the low impedance point for each reference element 210, 220.

Moving the variable secondary radiator 250 shown in FIG. 2 in the Y direction, the Z direction, or various combinations of the X, Y, and Z directions can create additional return loss curves. In addition to the result of the higher frequency band shifting lower and the lower frequency band shifting higher, depending on the configuration of the reference antenna 230, the configuration of the secondary radiator 250, and their relative movements, both the higher and lower frequency bands can shift higher, both the higher and lower frequency bands can shift lower, or the higher frequency band can shift higher while the lower frequency band shifts lower.

Figure 6:
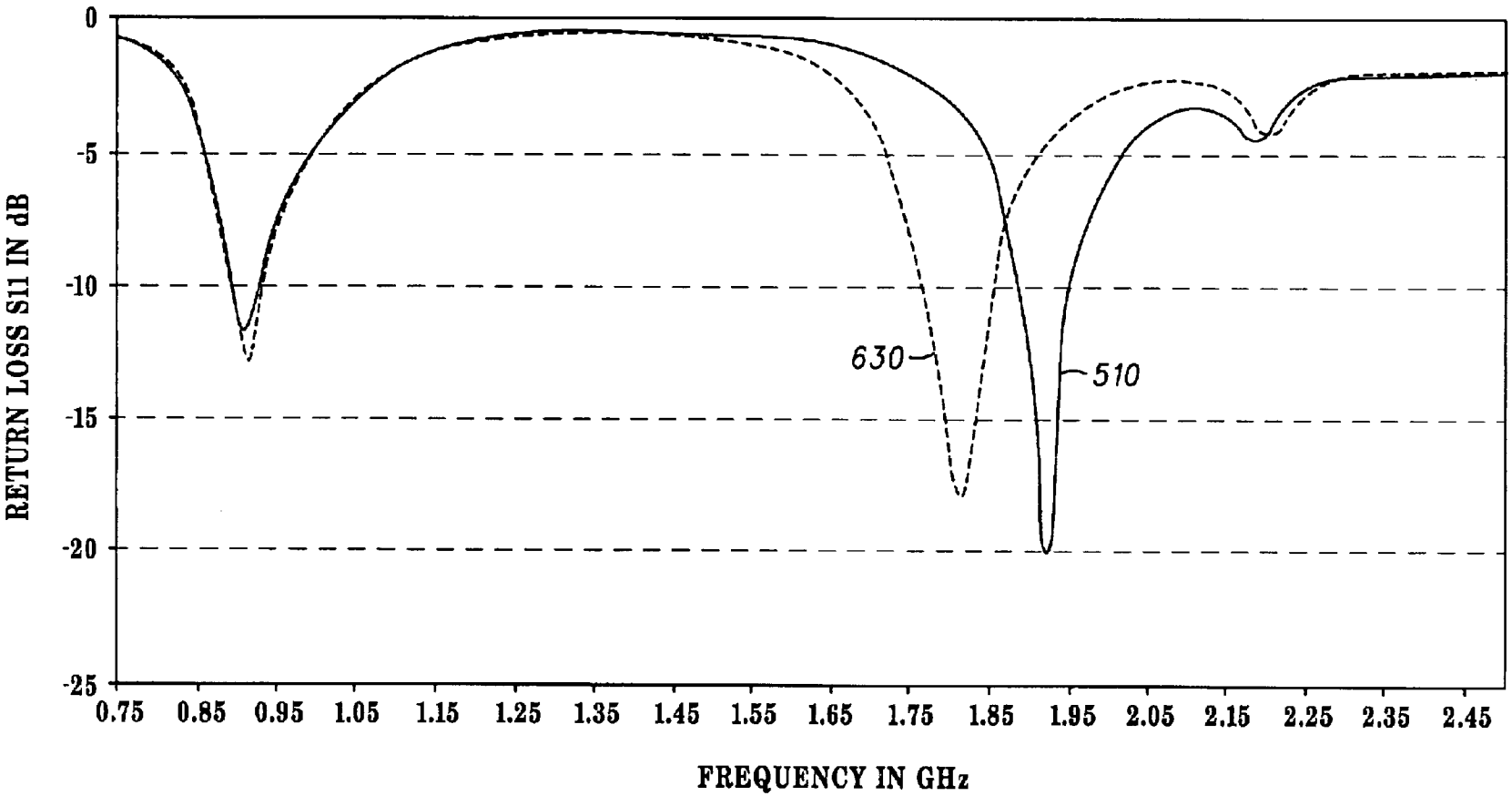
FIG. 6 shows additional return losses for the first preferred embodiment shown in FIGS. 2 and 3.

FIG. 6 shows additional return losses for the first preferred embodiment shown in FIGS. 2 and 3. For comparison purposes, curve 510 from FIG. 5 is shown. Movement of the variable secondary radiator 250 shown in FIG. 2 to position 3 in the X direction results in a curve 630 that has little movement at the low band and significant movement at the high band. Theoretically, when the variable secondary radiator 250 shown in FIG. 2 is at position 3 shown in FIG. 2, the high-band capacitance structure 256 becomes dominant, and the first low-band capacitance structure 252 and the second low-band capacitance structure 254 have negligible effects, because the secondary radiator is positioned near the low impedance point of the high-band reference element 220. FIG. 6 shows how the variable multi-band planar antenna assembly can be used to modify a dual-band planar reference antenna 230 to cover at least three frequency bands simply by moving the variable secondary radiator 250 shown in FIG. 2 in the X direction. Of course, the converse result can be achieved where the high band has relatively little movement while the low band shifts either up or down.

Figure 7:
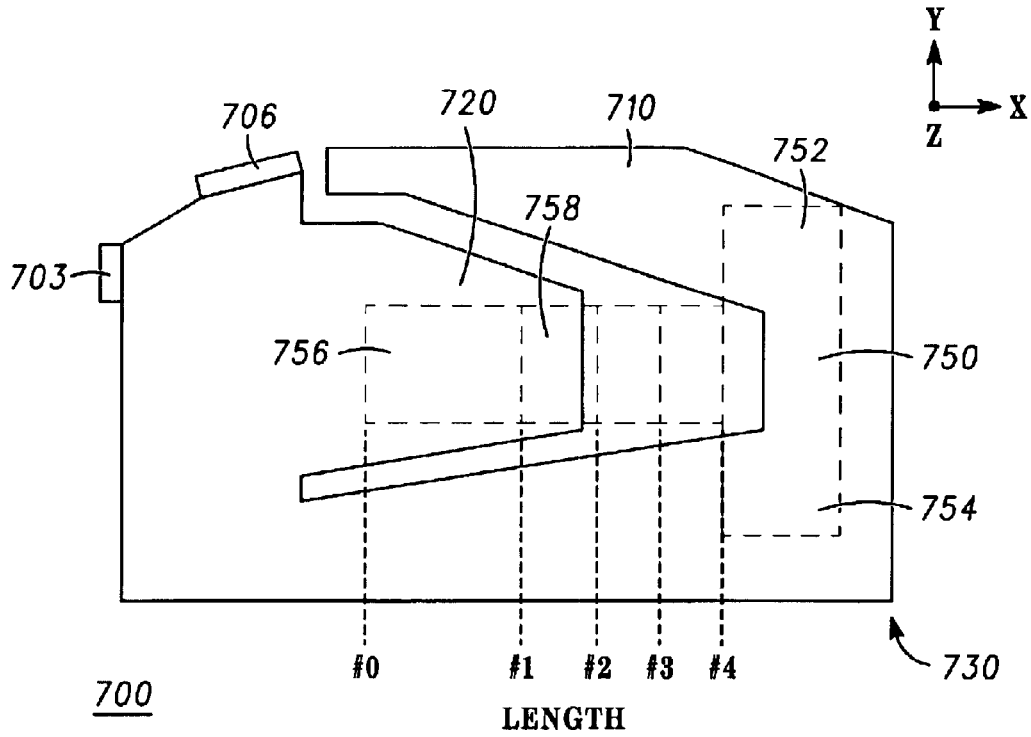
FIG. 7 shows a top view of a variable multi-band planar antenna assembly according to a second preferred embodiment.

FIG. 7 shows a top view of a variable multi-band planar antenna assembly 700 according to a second preferred embodiment. In this second preferred embodiment, a dual-band planar reference antenna 730 is in the form of a C-shaped PIFA with a low-band reference element 710 and a high-band reference element 720. Dual-band planar reference antenna 730 includes a feed post 703 and a ground post 706. Alternate dual-band planar reference antenna geometries are possible, including L, N, M, W, and meandering PIFAs. Additionally, PILAs (planar inverted-L antennas) and other planar antennas can be used as dual-band planar reference antennas. This second preferred embodiment uses a C-shaped PIFA antenna due to its small size and compact shape.

A variable secondary radiator 750, formed in the shape of a T, has a first low-band capacitance structure 752, a second low-band capacitance structure 754, a high-band capacitance structure 756, and an inductance structure 758. The geometry of this variable secondary radiator 750 is due in part to the geometry of the geometry of the C-shaped PIFA dual-band planar reference antenna 730. The geometry of the variable secondary radiator 750 is adjustable in the X, Y, and Z dimensions. In the second embodiment, the desired results for a quad-band GSM mobile telephone can be achieved with dimensional adjustment simply in the length of the leg of the T shape of the secondary radiator 750, which changes the high-band capacitance structure 756 and/or the inductance structure 758. Sample lengths of the leg of the T shape of the secondary radiator 750 are shown as lengths 0, 1, 2, 3, and 4. Note that length 4 reduces the leg length of the T shape to zero, which results in a bar shape. The leg of the T shape of the secondary radiator 750 can be adjusted using techniques such as mechanically or electrically switching in lengthening elements.

The length of the crossbar of the T shape of the secondary radiator 750 can also be adjusted to achieve different effects. Furthermore, the thickness of the secondary radiator 750 and/or the thickness of the dielectric layer 337 shown in FIG. 3 can be adjusted or varied to create more results. Depending on the desired frequency bands and bandwidths, adjustments of the structures, geometries, or spacings in the X, Y, and/or Z direction can be used to achieve the desired multi-band properties.

Figure 8:
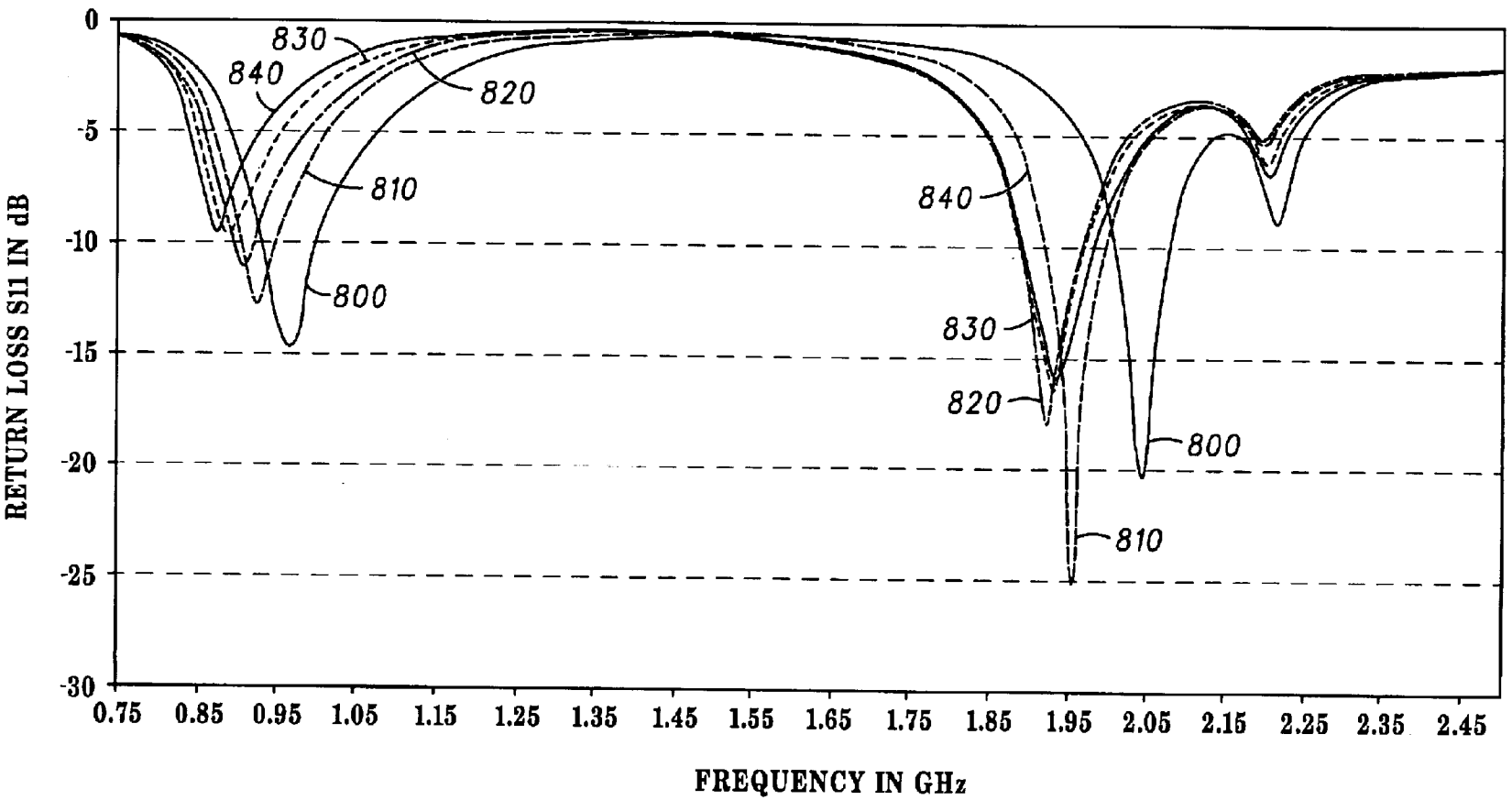
FIG. 8 shows return losses for the second preferred embodiment shown in FIG. 7.

FIG. 8 shows return losses for the second preferred embodiment shown in FIG. 7. The dual-band planar reference antenna 730 with the leg of the T shape of the variable secondary radiator 750 having length 0 shown in FIG. 7 creates a curve 800 with poles at approximately 0.96 GHz and 2.05 GHz]. Adjustment of the leg of the T shape of the variable secondary radiator 750 to lengths 1, 2, 3, and 4 shown in FIG. 7 results in further changes to the pole locations as shown by curves 810, 820, 830, and 840 respectively. FIG. 8 demonstrates how the variable multi-band planar antenna assembly can be used to modify a dual-band planar reference antenna 730 to cover at least four frequency bands simply by adjusting the length of the leg of the T shape of the variable secondary radiator 750 shown in FIG. 7. In this situation, the two GSM frequency pairs are achieved simply by using the lengthening technique.

Adjusting the dimensions of the secondary radiator 750 shown in FIG. 7 in the Y direction, the Z direction, or various combinations of the X, Y, and Z directions can create additional return loss curves. In addition to the result of the higher frequency band shifting lower and the lower frequency band shifting higher, both the higher and lower frequency bands can shift higher, both the higher and lower frequency bands can shift lower, or the higher frequency band can shift higher while the lower frequency band shifts lower. Other results can be achieved where one frequency band stays relatively the same while the other frequency band shifts either up or down.

Movement of a secondary radiator (and/or the dual-band planar reference antenna element), as described in connection with FIGS. 2 and 3, and dimensional adjustment of a secondary radiator, as described in connection with FIG. 7, can be combined to result in both movement and dimensional adjustment of a secondary radiator. Additionally, different geometries can be used for the secondary radiator, in conjunction with various reference antenna geometries, depending on what variations are needed to satisfy the frequency band and bandwidth requirements of a particular variable multi-band planar antenna assembly application.

Figure 9:
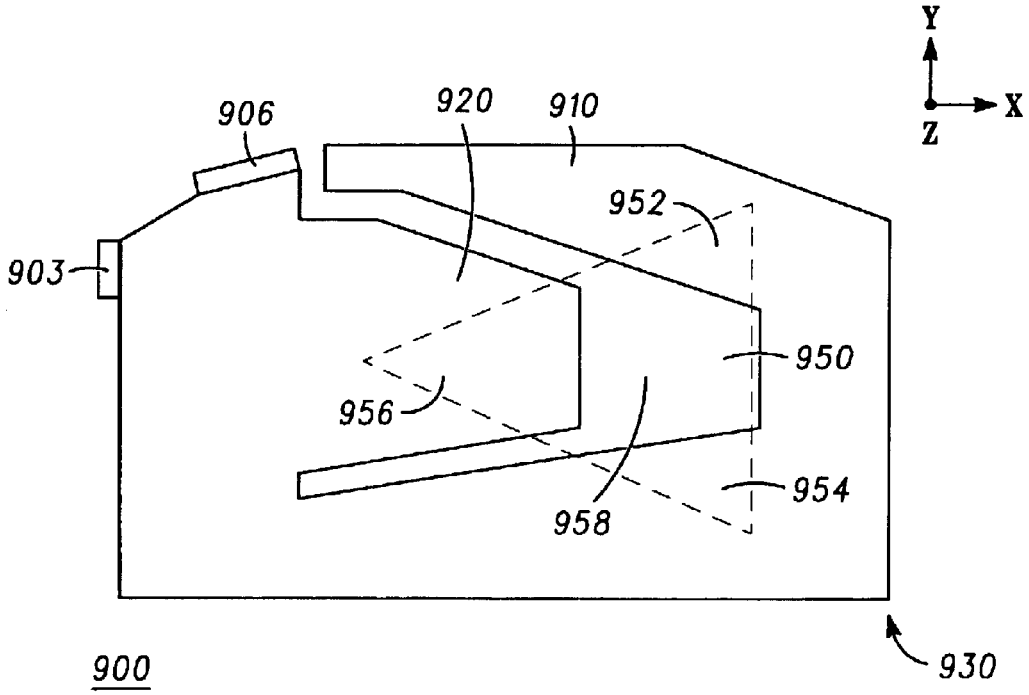
FIG. 9 shows a top view of a variable multi-band planar antenna assembly according to a third preferred embodiment.

FIG. 9 shows a top view of a variable multi-band planar antenna assembly 900 according to a third preferred embodiment. In this third preferred embodiment, a dual-band planar reference antenna 930 is in the form of a C-shaped PIFA with a low-band reference element 910 and a high-band reference element 920. Dual-band planar reference antenna 930 includes a feed post 903 and a ground post 906. Alternate dual-band planar reference antenna geometries are possible, including L, N, M, W, and meandering PIFAs. Additionally, PILAs (planar inverted-L antennas) and other planar antennas can be used as dual-band planar reference antennas. This third preferred embodiment uses a C-shaped PIFA antenna due to its small size and compact shape.

A variable secondary radiator 950, formed in the shape of a triangle, has a first low-band capacitance structure 952, a second low-band capacitance structure 954, a high-band capacitance structure 956, and an inductance structure 958. The geometry of this variable secondary radiator 950 is due in part to the geometry of the geometry of the C-shaped PIFA dual-band planar reference antenna 930. The variable secondary radiator 950 is both moveable and adjustable in the X, Y, and Z dimensions. Using the techniques described, the dimensions, geometries, and/or the position of the variable secondary radiator 950 and/or the dual-band planar reference antenna 930 can be modified to create desired frequency shifts and bandwidths for different applications.

Many other configurations are available for a secondary radiator, including strap wires in horizontal, vertical, and diagonal orientations as well as combinations of strap wires that produce an L, X, or other shape. Additionally, a secondary radiator is not limited to a unitary piece; a secondary radiator can be formed from two or more secondary radiator elements that can be moved simultaneously and/or independently in any direction. Additionally, secondary radiator elements can be electrically switched into the antenna structure. Depending on the application using the variable multi-band planar antenna assembly, different types of secondary radiators allow finer or coarser tuning adjustments with respect to bandwidth and resonant frequency bands.

Figure 10:
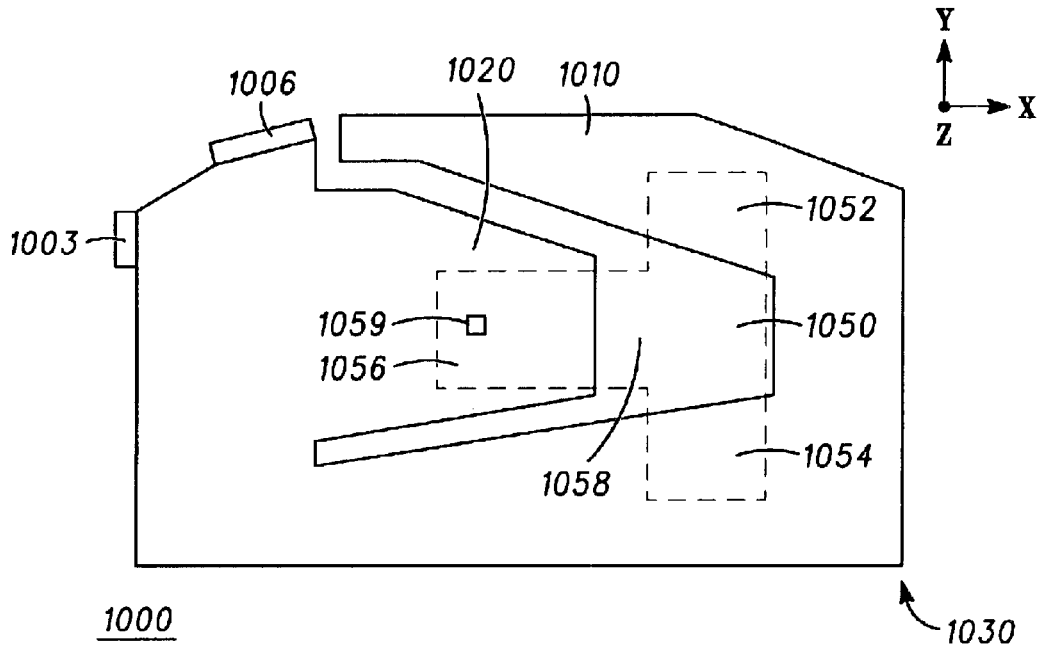
FIG. 10 shows a top view of a variable multi-band planar antenna assembly according to a fourth preferred embodiment.

FIG. 10 shows a top view of a variable multi-band planar antenna assembly 1000 according to a fourth preferred embodiment. In this fourth preferred embodiment, a dual-band planar reference antenna 1030 is in the form of a C-shaped PIFA with a low-band reference element 1010 and a high-band reference element 1020. Dual-band planar reference antenna 1030 includes a feed post 1003 and a ground post 1006. Alternate dual-band planar reference antenna geometries are possible, including L, N, M, W, and meandering PIFAs. Additionally, PILAs (planar inverted-L antennas) and other planar antennas can be used as dual-band planar reference antennas. This fourth preferred embodiment uses a C-shaped PIFA antenna due to its small size and compact shape.

A variable secondary radiator 1050, formed in the shape of a T, has a first low-band capacitance structure 1052, a second low-band capacitance structure 1054, a high-band capacitance structure 1056, and an inductance structure 1058. Additionally, the variable multi-band planar antenna assembly 1000 includes an inductor element 1059. Preferably, the inductor element 1059 is placed between the dual-band planar reference antenna 1030 and the variable secondary radiator 1050. In this fourth preferred embodiment, the inductor element 1059 mounts on the bottom surface of the variable secondary radiator 1050. The inductor element can be physically mounted or electrically coupled differently than shown. The inductor element 1059 increases the coupling of the secondary radiator 1050 to the reference antenna 1030. The geometry of this variable secondary radiator 1050 is due in part to the geometry of the geometry of the C-shaped PIFA dual-band planar reference antenna 1030. The position of the variable secondary radiator 1050 is stationary in this embodiment, but its position can be adjusted in the X, Y, and Z dimensions, and the inductance of the inductor element 1059 is also variable.

Figure 11:
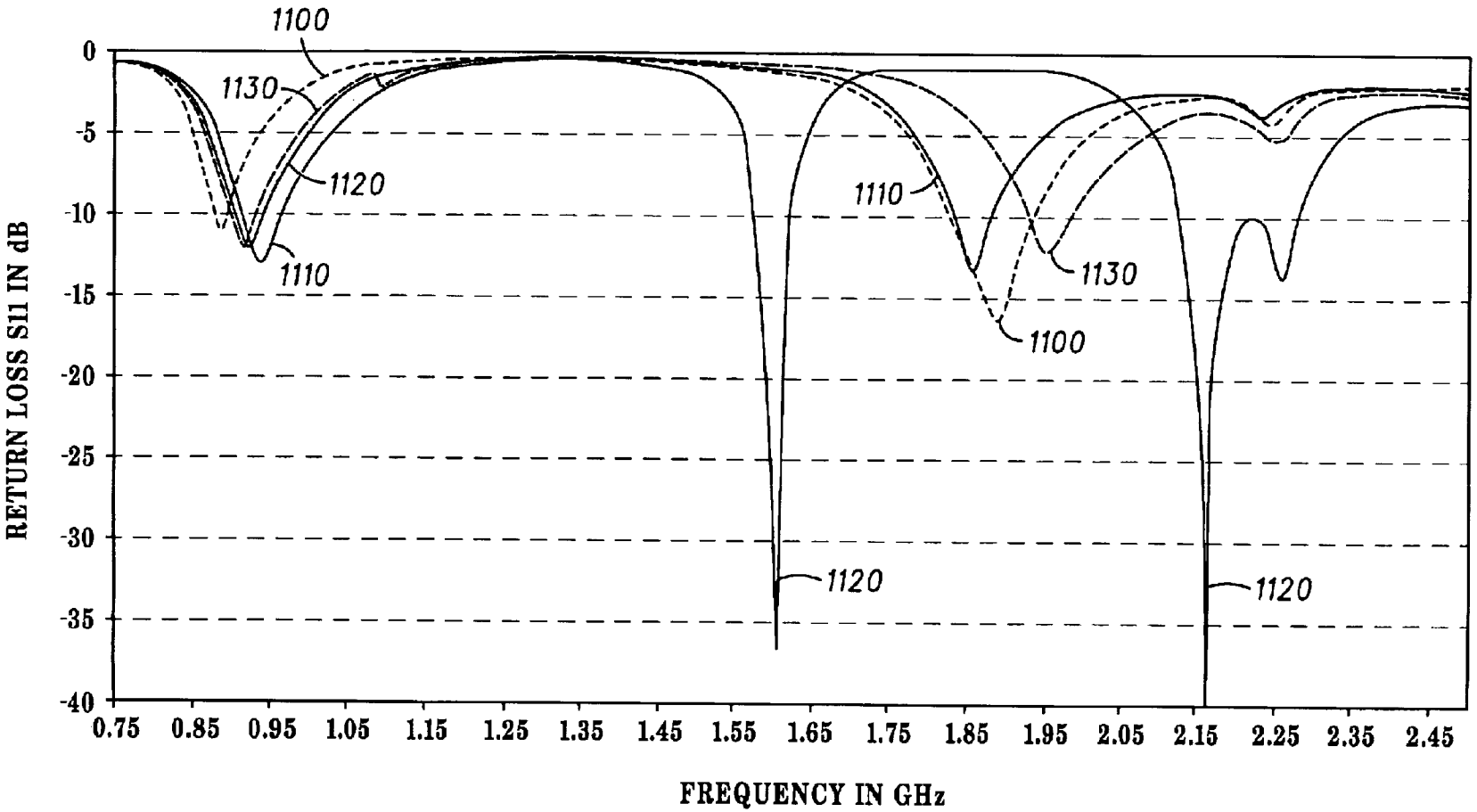
FIG. 11 shows return losses for the fourth preferred embodiment shown in FIG. 10.

FIG. 11 shows return losses for the fourth preferred embodiment shown in FIG. 10. By keeping the position and dimension of the variable secondary radiator 1050 constant, the effect of changing the value of the inductor element 1059 can be seen. The dual-band planar reference antenna 1030 shown in FIG. 10 has a curve 1100 with poles at approximately 0.87 GHz and 1.86 GHz. Adding the variable secondary radiator 1050 with a variable inductor element 1059 as shown in FIG. 10 creates different curves for different inductance values. For example, an inductance value of 0 results in a curve 1110 with poles at approximately 0.93 GHz and 1.85 GHz. Increasing the inductor value to 2.7 nH and 5.6 nH results in further changes to the pole locations as shown by curves 1120 and 1130 respectively. FIG. 11 demonstrates how the variable multi-band planar antenna assembly can be used to modify a dual-band planar reference antenna 1030 simply by adjusting the value of an inductor element 1059. Moving the variable secondary radiator 1050 shown in FIG. 10, and/or adjusting the dimensions of the variable secondary radiator 1050, and/or adjusting the value of an inductor element 1059 can create additional return loss curves. Depending on the configuration of the reference antenna 1030, the configuration of the secondary radiator 1050, the relative movements of the reference antenna 1030 and the secondary radiator 1050, and the value of the inductor element 1059, both the higher and lower frequency bands can shift higher, both the higher and lower frequency bands can shift lower, the higher frequency band can shift higher while the lower frequency band shifts lower, as well as the higher frequency band shifting lower while the lower frequency band shifts higher. Other results can be achieved where one frequency band stays relatively the same while the other frequency band shifts either up or down.

Figure 12:
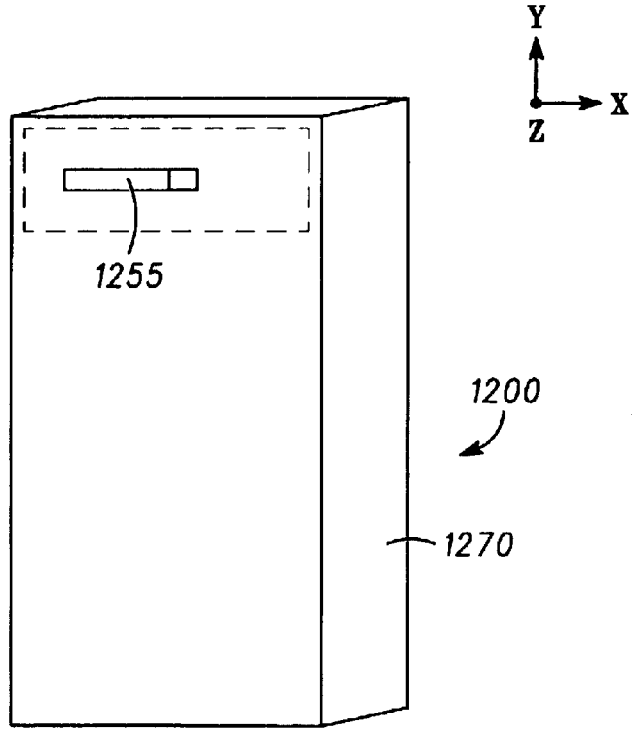
FIG. 12 shows an implementation of a variable multi-band planar antenna assembly in accordance with the first preferred embodiment in a wireless communication device such as a mobile telephone.

FIG. 12 shows an implementation of a variable multi-band planar antenna assembly in accordance with the first preferred embodiment in a wireless communication device 1200 such as a mobile telephone. As described previously, the variable multi-band planar antenna assembly 200 shown in FIG. 2 can cover all four GSM frequency bands (GSM 850, E-GSM 900, DCS 1800, and PCS 1900) for a mobile telephone simply with movement of the variable secondary radiator 250 shown in FIG. 2 in the X direction. This movement can be actuated by a user of a wireless communication device 1200 through a latch 1255 in a housing 1270. Additionally, a sensor can be included in the housing to check whether the user has placed the latch in the correct position for use of the mobile telephone in the desired frequency band.

Figure 13:
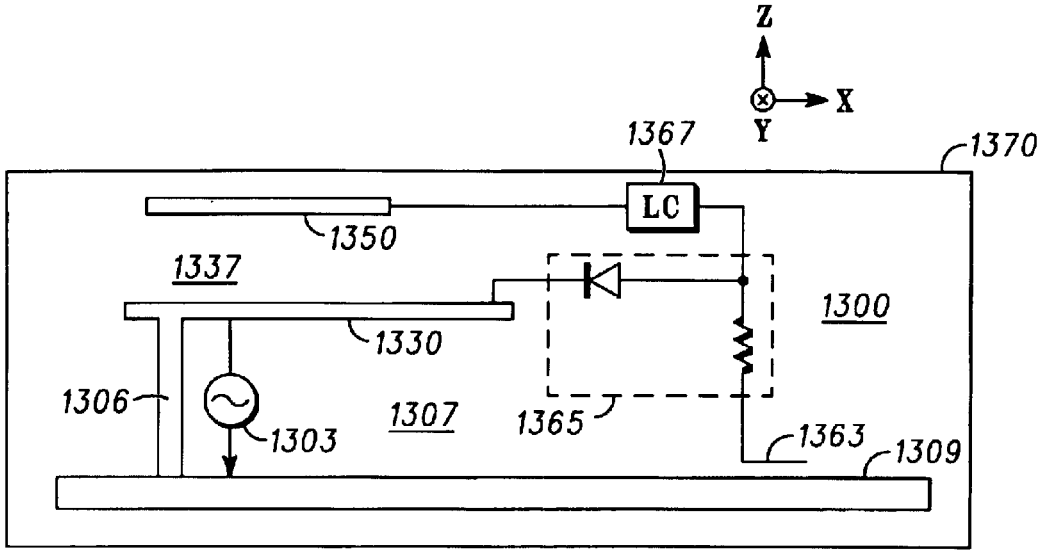
FIG. 13 shows a side view of a variable multi-band planar antenna assembly according to a fifth preferred embodiment.

FIG. 13 shows a side view of a variable multi-band planar antenna assembly 1300 according to a fifth preferred embodiment. A dielectric layer 1307 separates a dual-band planar reference antenna 1330 from a ground plane 1309. The dielectric layer 1307 can be an air gap, plastic, printed circuit board (FR4), Mylar™ polyester film, ceramic, or other material. Because the dual-band planar reference antenna 1330 is a PIFA in this fifth preferred embodiment, the dual-band planar reference antenna 1330 also includes a feed structure 1303 and a fixed gamma match ground structure 1306.

Another dielectric layer 1337, which can be an air gap, plastic, printed circuit board (FR4), Mylar™ polyester film, ceramic, or other material, separates a variable secondary radiator 1350 from the dual-band planar reference antenna 1330. In this fifth preferred embodiment, the variable secondary radiator 1350 mounts to a housing 1370 of the variable multi-band planar antenna assembly 1300. Alternately, the variable secondary radiator 1350 could be mounted to the variable multi-band planar antenna assembly 1300. Additionally, the variable secondary radiator 1350 could be mounted below the dual-band planar reference antenna 1330. Preferably, the housing 1370 is constructed of plastic and has only minor effects on the performance of the variable multi-band planar antenna assembly 1300. Additionally, the variable secondary radiator 1350 is moveable in the X, Y, and/or Z directions and the dimensions of the variable secondary radiator 1350 can be adjusted in the X, Y, and/or Z directions.

Also, an inductance/capacitance structure 1367 is electrically coupled to the variable secondary radiator 1350 and electrically coupled to the dual-band planar reference antenna 1330. Preferably, the inductance/capacitance structure 1367 has individual elements with constant values, and the individual elements can be electrically coupled to and decoupled from the dual-band planar reference antenna 1330 using one or more switching devices 1365 responsive to a selection signal from line 1363. The switching devices can be implemented as PIN diodes, varactor diodes, FET switches, MEMS (micro-electro mechanical systems) switches, or other solid-state switches. In the fifth preferred embodiment, simply electrically coupling and decoupling individual elements in the variable inductance/capacitance structure 1367 can achieve the desired results for a quad-band GSM mobile telephone.

Additional results may be obtained by the further option of modifying the inductance and capacitance values, such as using a varactor diode, of the inductance/capacitance structure 1367 to adjust the overall bandwidth and resonance frequency when switching between frequency bands. The frequency tuning depends on the coupling between the variable secondary radiator 1350 with variable inductance/capacitance structure 1367 and the dual-band planar reference antenna element 1330, which is influenced partially by the distance between the dual-band planar reference antenna element 1330 and the variable secondary radiator 1350 as well as the inductance and capacitance values of the variable inductance/capacitance structure 1367.

Figure 14:
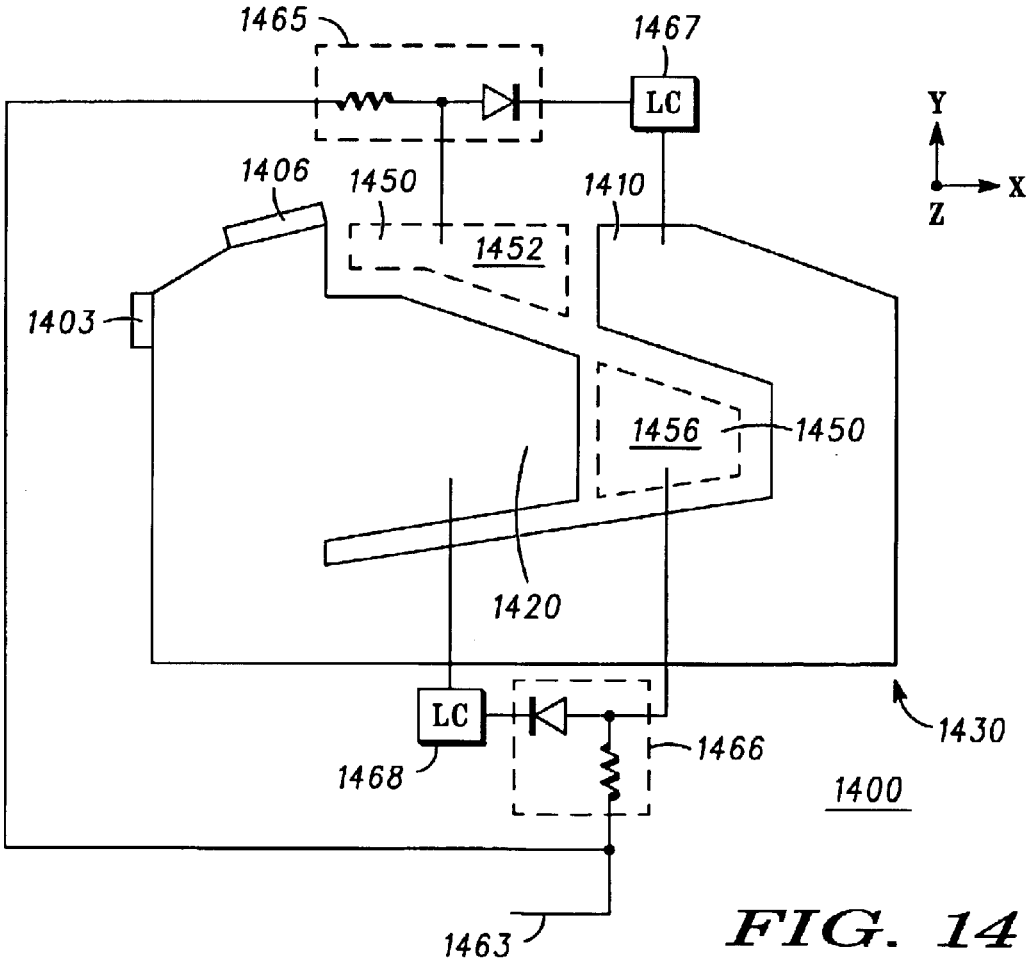
FIG. 14 shows a top view of a variable multi-band planar antenna assembly according to a sixth preferred embodiment.

FIG. 14 shows a top view of a variable multi-band planar antenna assembly 1400 according to a sixth preferred embodiment. In this sixth preferred embodiment, a dual-band planar reference antenna 1430 is in the form of a C-shaped PIFA with a low-band reference element 1410 and a high-band reference element 1420. Dual-band planar reference antenna 1430 includes a feed post 1403 and a ground post 1406. Alternate dual-band planar reference antenna geometries are possible, including L, N, M, W, and meandering PIFAs. Additionally, PILAs (planar inverted-L antennas) and other planar antennas can be used as dual-band planar reference antennas. This sixth preferred embodiment uses a C-shaped PIFA antenna due to its small size and compact shape.

A two-piece variable secondary radiator 1450 has a low-band capacitance structure 1452 and a high-band capacitance structure 1456. Note that the secondary radiator 1450 does not have to overlap the reference antenna 1430. Also, an inductance/capacitance structure 1467 is electrically coupled to the low-band capacitance structure 1452 and the dual-band planar reference antenna 1430. Another inductance/capacitance structure 1468 is electrically coupled to the high-band capacitance structure 1456 and the dual-band planar reference antenna 1430. Preferably, the inductance/capacitance structures 1467, 1468 have individual elements with constant values, and the individual elements can be electrically coupled to and decoupled from the dual-band planar reference antenna 1430 using one or more switching devices 1465, 1466 responsive to a selection signal from line 1463. The switching devices can be implemented as PIN diodes, varactor diodes, FET switches, MEMS (micro-electro mechanical systems) switches, or other solid-state switches.

Figure 15:
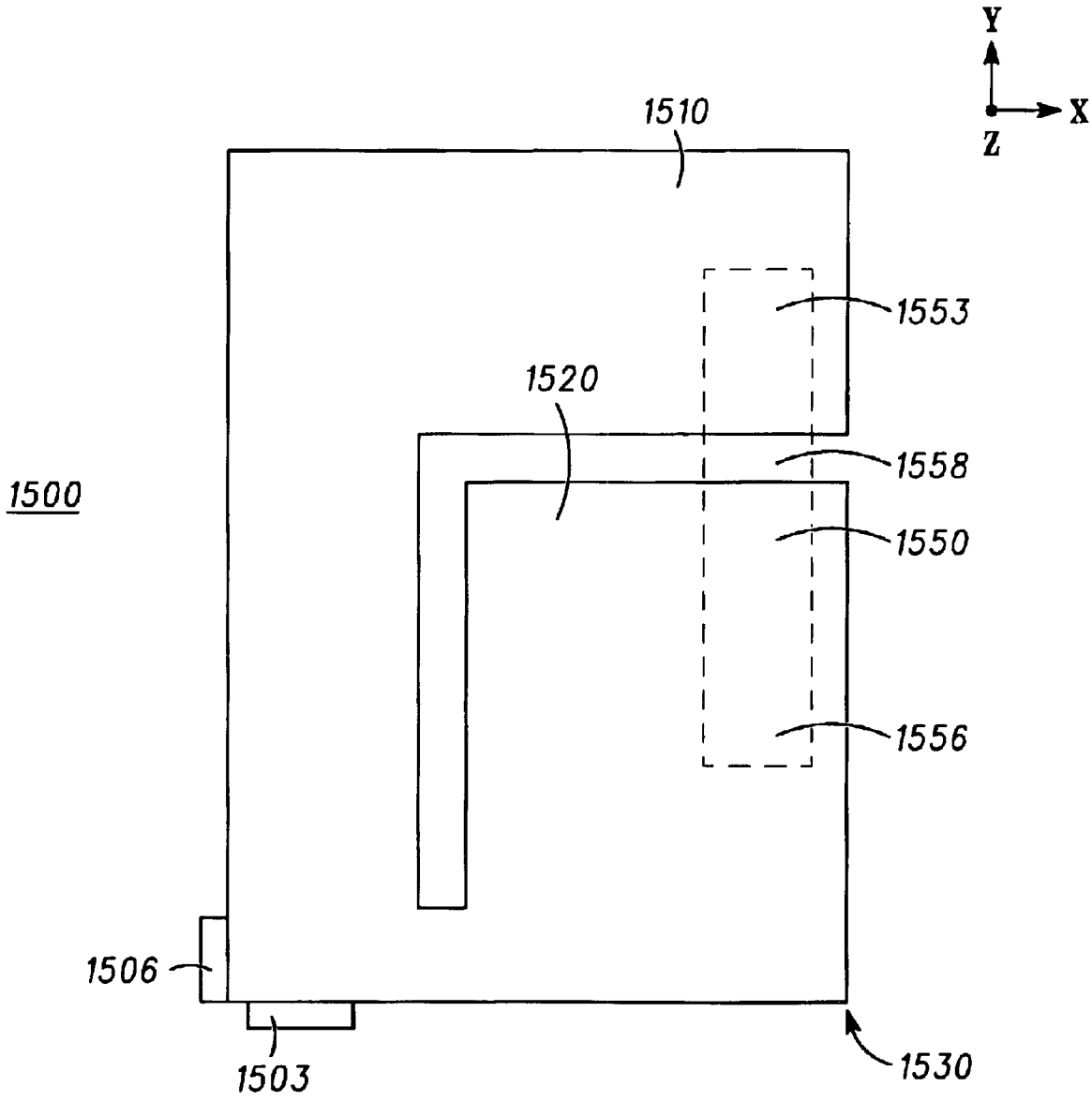
FIG. 15 shows a top view of a variable multi-band planar antenna assembly according to a seventh preferred embodiment.

Additional results may be obtained by the further option of modifying the inductance and capacitance values, such as using a varactor diode, of the inductance/capacitance structures 1467, 1468 to adjust the overall bandwidth and resonance frequency when switching between frequency bands. Also, the variable secondary radiator 1450 pieces can be moveable independently in the X, Y, and Z directions and/or independently electrically switchable. The frequency tuning depends on the coupling between the variable secondary radiator 1450 pieces with the variable inductance/capacitance structures 1467, 1468 and the dual-band planar reference antenna element 1430, which is influenced partially by the distance between the dual-band planar reference antenna element 1430 and the variable secondary radiator 1450 pieces as well as the inductance and capacitance values of the variable inductance/capacitance structures 1467, 1468. As stated previously, the possible geometries and positions of the secondary radiator are at least partially influenced by the shape and configuration of the reference antenna element. FIG. 15 shows a top view of a variable multi-band planar antenna assembly 1500 according to a seventh preferred embodiment. In this seventh preferred embodiment, a dual-band planar reference antenna 1530 is in the form of an L-shaped PIFA with a low-band reference element 1510 and a high-band reference element 1520. Dual-band planar reference antenna 1530 includes a feed post 1503 and a ground post 1506. Alternate dual-band planar reference antenna geometries are possible, including N, M, W, and meandering PIFAs. Additionally, PILAs (planar inverted-L antennas) and other planar antennas can be used as dual-band planar reference antennas. This seventh preferred embodiment uses an L-shaped PIFA antenna due to its small size and compact shape.

A variable secondary radiator 1550, formed in the shape of an I, has a low-band capacitance structure 1553, a high-band capacitance structure 1556, and an inductance structure 1558. The geometry of this variable secondary radiator 1550 is due in part to the geometry of the L-shaped PIFA dual-band planar reference antenna 1530. Alternate secondary radiator geometries are available for an L-shaped PIFA dual-band planar reference antenna, such as a T-shaped secondary radiator or an upside-down-L-shaped secondary radiator. If a dual-band planar reference antenna has a different geometry, differently-shaped variable secondary radiator may be more appropriate. The variable secondary radiator 1550 is moveable in the X, Y, and Z directions.

Instead of moving the secondary resonator 1550 to vary the capacitances and inductances of the variable multi-band planar antenna assembly 1500, the secondary resonator 1550 can be stationary and the dual-band planar reference antenna 1530 can be moved instead. Additionally, both the secondary resonator 1550 and the dual-band planar reference antenna 1530 could be moveable. Because the relative positions of the secondary resonator 1550 and the dual-band planar reference antenna 1530 affect the capacitances and inductances of the variable multi-band planar antenna assembly 1500, a variety of physical options can be used to achieve the desired results.

Figure 16:
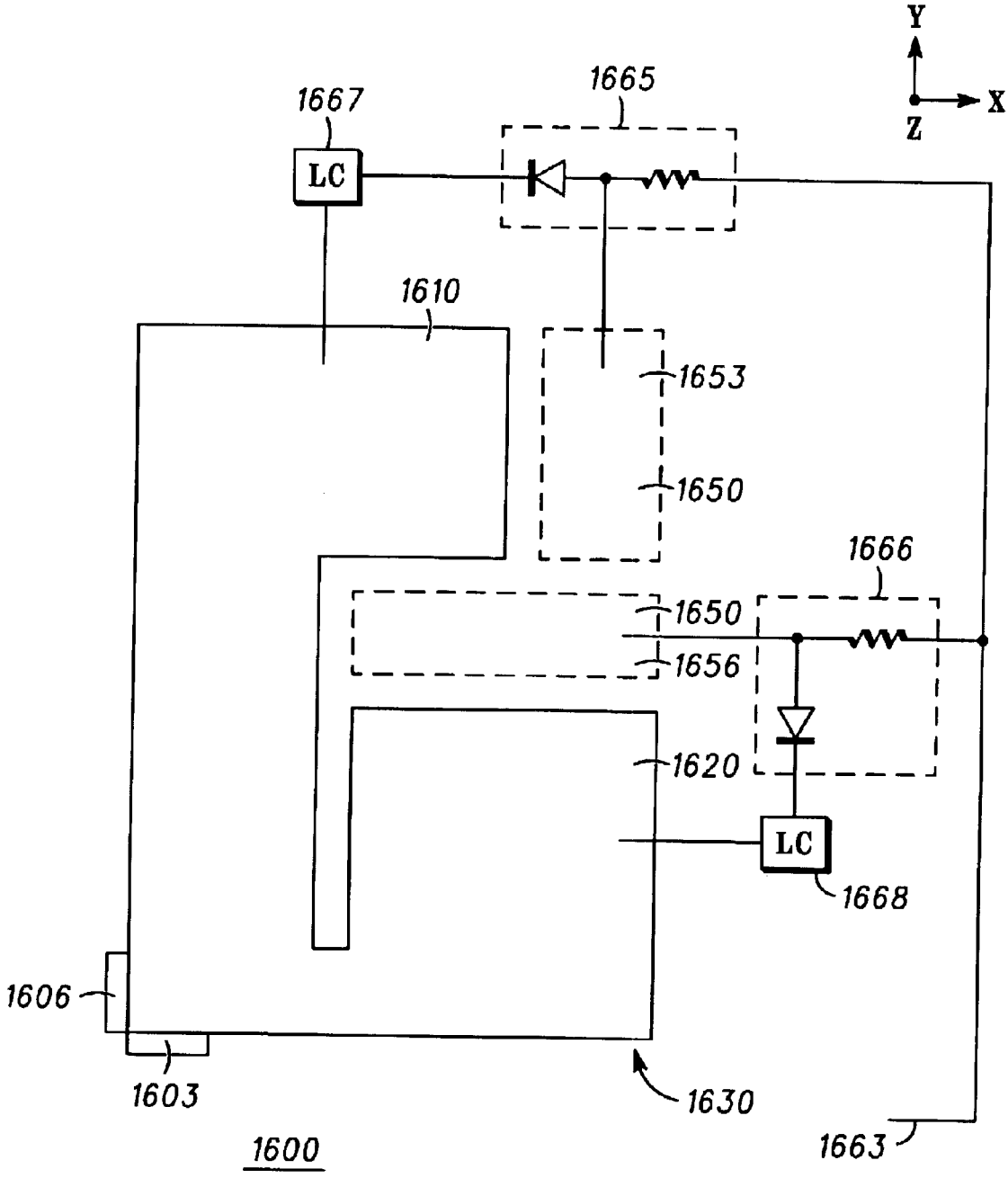
FIG. 16 shows a top view of a variable multi-band planar antenna assembly according to an eighth preferred embodiment.

FIG. 16 shows a top view of a variable multi-band planar antenna assembly 1600 according to an eighth preferred embodiment. In this eighth preferred embodiment, a dual-band planar reference antenna 1630 is in the form of an L-shaped PIFA with a low-band reference element 1610 and a high-band reference element 1620. Dual-band planar reference antenna 1630 includes a feed post 1603 and a ground post 1606. Alternate dual-band planar reference antenna geometries are possible, including N. M, W, and meandering PIFAs. Additionally, PILAs (planar inverted-L antennas) and other planar antennas can be used as dual-band planar reference antennas. This eighth preferred embodiment uses an L-shaped PIFA antenna due to its small size and compact shape.

A two piece variable secondary radiator 1650 has a low-band capacitance structure 1653 and a high-band capacitance structure 1656. Note that the secondary radiator 1650 does not have to overlap the reference antenna 1630. Also, an inductance/capacitance structure 1667 is electrically coupled to the low-band capacitance structure 1653 and the dual-band planar reference antenna 1630. Another inductance/capacitance structure 1668 is electrically coupled to the high-band capacitance structure 1656 and the dual-band planar reference antenna 1630. Preferably, the inductance/capacitance structures 1667, 1668 have individual elements with constant values, and the individual elements can be electrically coupled to and decoupled from the dual-band planar reference antenna 1630 using one or more switching devices 1665, 1666 responsive to a selection signal from line 1663. The switching devices can be implemented as PIN diodes, varactor diodes, FET switches, MEMS (micro-electro mechanical systems) switches, or other solid-state switches.

Additional results may be obtained by the further option of modifying the inductance and capacitance values, such as using a varactor diode, of the inductance/capacitance structures 1667, 1668 to adjust the overall bandwidth and resonance frequency when switching between frequency bands. Also, the variable secondary radiator 1650 pieces can be moveable independently in the X, Y, and Z directions and/or independently electrically switchable. The frequency tuning depends on the coupling between the variable secondary radiator 1650 pieces with the variable inductance/capacitance structures 1667, 1668 and the dual-band planar reference antenna element 1630, which is influenced partially by the distance between the dual-band planar reference antenna element 1630 and the variable secondary radiator 1650 pieces as well as the inductance and capacitance values of the variable inductance/capacitance structures 1667, 1668.

Thus, a variable multi-band planar antenna assembly provides a multi-band antenna that can be applicable to different sets of frequency bands, different bandwidths, and different physical structures. The techniques described can be used for frequency bands other than the four GSM frequency bands. For example, the techniques can be used to design a variable multi-band planar antenna useable in the global position system (GPS) frequency band (1.57 GHz), the Bluetooth frequency band (2.4 GHz), the 802.11*a* wireless LAN frequency band (5.2 Ghz), and/or the 802.11*b* wireless LAN frequency band (2.4 GHz).

Additionally, the variable multi-band planar antenna can be used to simplify manufacturing and reduce inventory for device manufacturers. For example, the same reference antenna element can be installed on various devices. Later during the manufacturing process, or even after manufacture, an appropriate secondary radiator can be permanently positioned to achieve resonance at the desired frequencies. A generic dual-band GSM mobile telephone can be created for either the U.S. or European markets by first installing a reference antenna such as the reference antenna 230 shown in FIG. 2. Later, when the manufacturer knows whether the mobile telephone will be used in the United States or Europe, the manufacturer can permanently affix an appropriate secondary radiator in the appropriate position. For example, a dual-band U.S. GSM mobile telephone would have a secondary radiator 250 installed at position 1 shown in FIG. 2 while a dual-band European GSM mobile telephone would have the same secondary radiator 250 installed at position 2 shown in FIG. 2. Under such circumstances, an appropriate secondary radiator can be stamped, painted, or printed onto an inner surface of a housing for the variable multi-band planar antenna assembly. Alternately, the dual-band planar reference antenna can be stamped, painted, or printed onto an inner surface of a housing while the secondary radiator is properly positioned within the housing.

The variable multi-band planar antenna assembly is not limited to a single secondary radiator element. Multiple secondary radiators can be used to increase the number of frequency bands available and to extend frequency bandwidths. The interaction between multiple secondary radiators, however, creates complications in the design process. This complication is in addition to the degrees of freedom available for each secondary radiator in terms of location, dimension, and values of inductance/capacitance elements. For certain applications, a single-band planar reference antenna can be used as part of a variable dual-band antenna assembly. The techniques shown or described can be combined to obtain the desired antenna performance and achieve band tuning, bandwidth, SAR [what does SAR stand for?], and antenna efficiency requirements.

While this disclosure includes what are considered presently to be the preferred embodiments and best modes of the invention described in a manner that establishes possession thereof by the inventors and that enables those of ordinary skill in the art to make and use the invention, it will be understood and appreciated that there are many equivalents to the preferred embodiments disclosed herein and that modifications and variations may be made without departing from the scope and spirit of the invention, which are to be limited not by the preferred embodiments but by the appended claims.

We claim:

1. A variable multi-band planar antenna assembly comprising:

a ground plane element, oriented in a first plane;

a planar reference antenna element having at least two resonant frequency bands, oriented in a second plane substantially parallel to the first plane; and a variable secondary radiator element electrically coupled to the planar reference antenna element oriented in third plane substantially parallel to the second plane.

2. A variable multi-band planar antenna assembly according to claim 1 wherein the planar reference antenna element is a dual-band planar inverted F antenna (PIFA).

3. A variable multi-band planar antenna assembly according to claim 2 wherein the planar reference antenna element is a C-shaped dual-band planar inverted F antenna (PIFA).

4. A variable multi-band planar antenna assembly comprising:

a ground plane element, oriented in a first plane;

a planar reference antenna element, oriented in a second plane substantially parallel to the first plane; and a variable secondary radiator element electrically coupled to the planar reference antenna element, oriented in a third plane substantially parallel to the second plane, wherein the variable secondary radiator element and the planar reference antenna element are designed to be variable in position relative to each other.

5. A variable multi-band planar antenna assembly according to claim 4 further comprising a latch, coupled to the variable secondary radiator element, for moving the variable secondary radiator element relative to the planar reference antenna element.

6. A variable multi-band planar antenna assembly comprising:

a ground plane element, oriented in a first plane;

a planar reference antenna element, oriented in a second plane substantially parallel to the first plane; and a variable secondary radiator element electrically coupled to the planar reference antenna element, oriented in a third plane substantially parallel to the second plane, wherein the variable secondary radiator element is variable in dimension.

7. A variable multi-band planar antenna assembly comprising:

a ground plane element, oriented in a first plane;

a planar reference antenna element, oriented in a second plane substantially parallel to the first plane; and a variable secondary radiator element electrically coupled to the planar reference antenna element, oriented in a third plane substantially parallel to the second plane, wherein a shape of the variable secondary radiator element is adjustable.

8. A variable multi-band planar antenna assembly comprising:

a ground plane element, oriented in a first plane;

a planar reference antenna element, oriented in a second plane substantially parallel to the first plane; and a variable secondary radiator element electrically coupled to the planar reference antenna element, oriented in a third plane substantially parallel to the second plane, wherein a surface area of the variable secondary radiator element is adjustable.

9. A variable multi-band planar antenna assembly comprising:

a ground plane element, oriented in a first plane;

a planar reference antenna element, oriented in a second plane substantially parallel to the first plane;

a variable secondary radiator element electrically coupled to the planar reference antenna element, oriented in a third plane substantially parallel to the second plane; and an electrical element, coupled to the variable secondary radiator element.

10. A variable multi-band planar antenna assembly according to claim 9 wherein the electrical element is an inductive/capacitive structure.

11. A variable multi-band planar antenna assembly according to claim 9 wherein the electrical element is a varactor diode.

12. A variable multi-band planar antenna assembly according to claim 9 further comprising:

a switch, coupled to the electrical element.

13. A variable multi-band planar antenna assembly comprising:

a ground plane element;

a low frequency band antenna element;

a high frequency band antenna element;

a feed structure electrically coupled to the low frequency band antenna element and the high frequency band antenna element;

a ground structure electrically coupled to the low frequency band antenna element and the high frequency band antenna element; and a variable secondary radiator electrically coupled to the low frequency band antenna element and the high frequency band antenna element.

14. A variable multi-band planar antenna assembly according to claim 13 wherein the variable secondary radiator is coupled to the low frequency band antenna element in at least two locations.

15. A variable multi-band planar antenna assembly according to claim 13 wherein the variable secondary radiator is coupled to the high frequency band antenna element in at least two locations.

16. A variable multi-band planar antenna assembly according to claim 13 wherein the variable secondary radiator and the low frequency band antenna element are designed to be moveable relative to each other.

17. A variable multi-band planar antenna assembly according to claim 13 wherein the variable secondary radiator and the high frequency band antenna element are designed to be moveable relative to each other.

18. A variable multi-band planar antenna assembly according to claim 13 further comprising:

a switch, for adjusting the electrical coupling of the variable secondary radiator to the low frequency band antenna element and the high frequency band antenna element.

19. A wireless communication device comprising:

a housing;

a ground plane element;

a low frequency band radiating element, coupled to a feed structure and the ground plane, having a low resonant frequency;

a high frequency band radiating element, coupled to the feed structure and the ground plane, having a high resonant frequency;

a variable secondary radiator element, electrically coupled to the low frequency band radiating element and the high frequency band radiating element, for creating variable capacitive coupling;

wherein the variable secondary radiator element can be varied to change the value of the variable capacitive coupling.

20. A wireless communication device comprising;

a housing;

a ground plane element;

a low frequency band radiating element, coupled to a feed structure and the ground plane, having a low resonant frequency;

a high frequency band radiating element, coupled to the feed structure and the ground plane, having a high resonant frequency;

a variable secondary radiator element, electrically coupled to the low frequency band radiating element and the high frequency band radiating element, for creating variable inductive coupling;

wherein the variable secondary radiator element can be varied to change the value of the variable inductive coupling.

* * * * *